United States Patent [19]

Aigner

[11] 4,279,349

[45] Jul. 21, 1981

[54] BOTTLE WITH SEPARATE COMPARTMENTS

[76] Inventor: Robert Aigner, Wienerstr. 171, A-2352 Gumpoldskirchen, Austria

[21] Appl. No.: 102,783

[22] Filed: Dec. 12, 1979

[30] Foreign Application Priority Data

Dec. 21, 1978 [AT] Austria ..... 9128/78

[51] Int. Cl.[3] ..... B65D 1/04

[52] U.S. Cl. ..... 215/6

[58] Field of Search ..... 215/6; 222/129

[56] References Cited

U.S. PATENT DOCUMENTS

| | | | |
|---|---|---|---|
| 337,344 | 3/1886 | Lytle | 215/6 X |
| 3,076,573 | 2/1963 | Thomas | 215/6 |
| 3,347,420 | 10/1967 | Donoghue | 222/129 |
| 4,065,536 | 12/1977 | Lucas | 215/6 X |

*Primary Examiner*—Donald F. Norton

[57] ABSTRACT

A bottle is constructed with separate compartments 4, 5 for different liquids. The neck 2 of the bottle is divided internally by a longitudinally extending partition 3, two sides of the each communicating exclusively with one of the compartments 4, 5.

4 Claims, 2 Drawing Figures

BOTTLE WITH SEPARATE COMPARTMENTS

The invention relates to bottles with separate compartments for storing different liquids, in particular liquids to be mixed.

Such bottles with two separately closeable necks have been used mostly for the separate storage of e.g. vinegar and oil.

The disadvantages of such bottles consists in that the two necks, which extend arcuately away from a central plane mostly protrude beyond the imaginary encasing body determined by the bottle body, which may have the form of a cylinder, cone, prism or pyramid. This results in large empty spaces between the bottles during transport and a risk of breakage since, during handling of such a bottle, knocking of the projecting necks, which are as a rule very susceptible to breakage, can happen very easily.

A further disadvantage of these known bottles is that for the production of mixed beverages, the contents of each individual compartment of the bottle, e.g. wine and mineral water, must be emptied separately, which requires the closure of each neck to be removed separately and the bottle to be turned after emptying the first chamber resulting in very complicated handling.

It is the object of the invention to provide a bottle of the aforementioned kind, which does not have increased susceptibility to breakage as compared to normal bottles and which is particularly suitable for the separate storage of liquids provided for the production of mixed beverages or the like, and is distinguished by particularly simple handling.

According to the invention, this is achieved with bottle comprising only one neck which is closable by conventional closure members, such as crown corks, which is divided by a partition extending in the longitudinal direction of the bottle and at the top of which the closure member can be brought into sealing abutment. Due to the arrangement of only one neck, which may be arranged centrally, as in ordinary bottles, and is consequently located within the imaginary casing determined by the body of the bottle, there results a substantially decreased risk of breakage compared with the known divided bottles.

Moreover, with the bottle according to the invention, all the compartments can be emptied at the same time, whereby very easy handling results in the production of mixed beverages, such as wine-mineral water mixtures or so-called long drinks.

Fundamentally, the volumes of the individual compartments of the bottle can be selected so as to be very different, which will be the case with bottles for long drinks.

In order to be able to influence the ratio of the individual components in the mixture produced, provision is made for the neck to pass into two separate bottle compartments which are closed by a common bottom and between which is provided an elongate gap defined at the top by the neck and at the bottom by the bottom, of the bottle, the gap preferably widening towards the periphery of the bottle. By separation of the bottle into two bottle compartments connected to each other only in the region of the neck and bottom, there results a relatively bulging shape, and moreover there results from the gap between the compartments a simple possibility of passing the bottles in alignment to the stations of a bottling plant. If, when pouring out liquid, the bottle is held in such a way that its dividing plane or the transverse axis of the bottle disposed therein extends approximately horizontally, liquid is retained in the lower compartment, while the upper compartment is completely emptied.

In this connection it is advantageous if the insides of the walls of the bottle compartments facing towards the dividing plane are farther removed therefrom over most of their area than the generatrix of the inside of the neck farthest from the dividing plane. In this development of the bottle, it is possible to retain a very considerable portion of the liquid contained in one of the compartments.

Suitably, provision is also made for the gap provided between the bottle compartments to widen downwardly, whereby complete emptying of the compartment of the bottle which is uppermost when the edge of the partition extends approximately horizontally is also made possible when the longitudinal axis of the bottle is inclined upwardly so that simultaneously only a little liquid runs out of the lower compartment of the bottle. In this way, the ratio of the components in the finished mixture can be varied to a large extent.

The invention will now be described by way of example with reference to the accompanying drawings in which.

The bottle 1 comprises a neck 2 which is divided by a partition 3 extending as far as the upper edge of the neck 2 the outside of which is shaped for closure by means of a crown cork.

Figure 1:
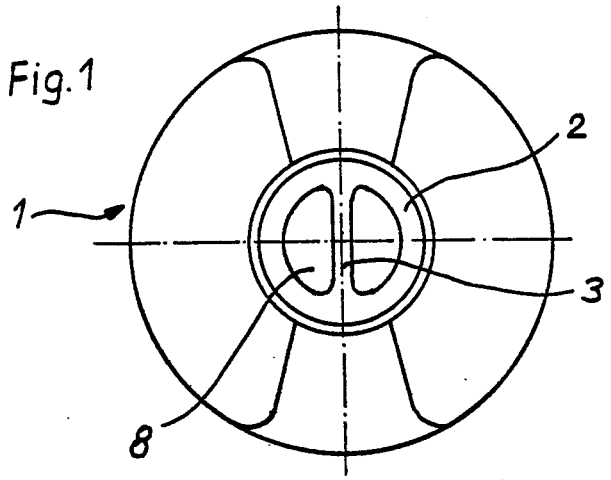
FIG. 1 shows a plan view.
Figure 2:
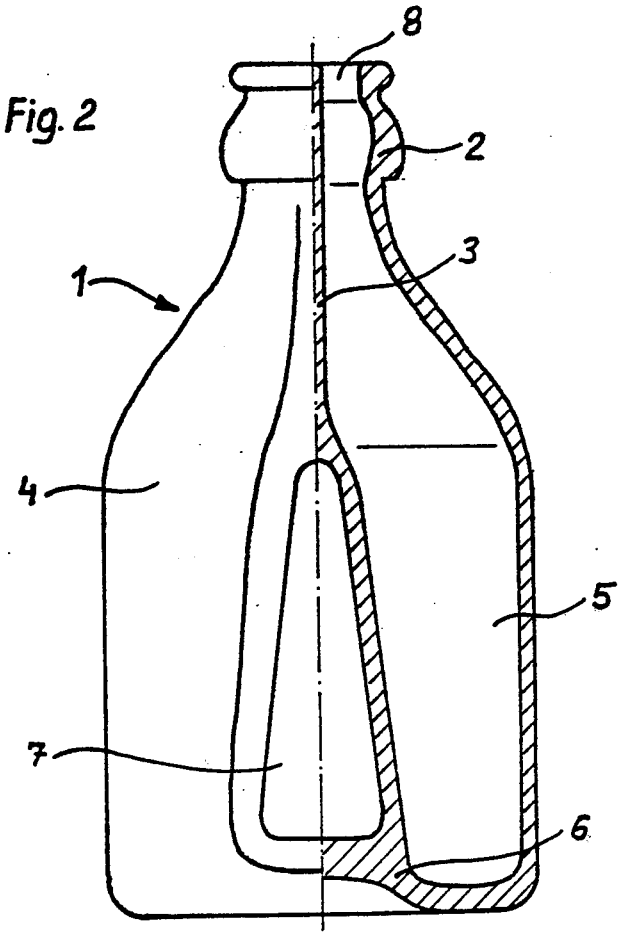
FIG. 2 shows a partly sectioned side view of a bottle embodying the invention.

Beneath the neck 2, the bottle 1 is divided into two bottle compartments 4 and 5 which are connected externally to each other only by the bottom 6 and the neck 2; the spaces defined by the compartments 4 and 5 do not communicate with other as is apparent form FIG. 2.

Between the two bottle compartments 4 and 5 is provided a gap 7 which widens towards the periphery of the bottle 1, which makes handling of the bottle easier. Moreover, the gap 7 widens downwardly and is closed by the bottom 6. As a result, the walls of the bottle compartments 4 and 5 facing towards each other extend obliquely, as a result of which it is possible, as already mentioned, to empty one of the bottle compartments 4 or 5 substantially less than the other. To this end it is only necessary to hold the bottle 1 in such a way that the front edge of the partition 3 (which extends approximately diametrically to the neck opening 8) is disposed approximately horizontally. The contents of the upper compartment of the bottle 4 or 5 can also be emptied practically completely in a position of the bottle in which its longitudinal axis is slightly inclined to the opening 8 of the neck 2, towards which only a little liquid exits from the lower compartment of the bottle.

In contrast therewith, uniform emptying of the two bottle compartments 4 and 5 occurs if the bottle is inclined with the partition 3 extending approximately vertically.

I claim:

1. A bottle comprising a common bottom, a common neck, two separate compartments extending from the bottom to the neck, the bottom being common to the two separate compartments, and a partition extending from the bottom to the neck between the two separate compartments of the bottle, the partition below the neck and over a portion of the height of the bottle being bifurcated into two partition walls defining therebetween an elongate gap closed by the common bottom.

2. The bottle of claim 1, wherein the gap between the two partition walls widens towards the bottom.

3. The bottle of claim 1, wherein the gap widens towards the periphery of the bottle.

4. The bottle of claim 1, each one of the compartments being defined respectively by the bottom, the partition and a peripheral wall, and the partition extending in a central dividing plane, the peripheral wall of each compartment having a portion farther removed from the dividing plane than another portion of the peripheral wall defining the neck.

* * * * *